US009581076B2

(12) United States Patent
Mushiga et al.

(10) Patent No.: US 9,581,076 B2
(45) Date of Patent: Feb. 28, 2017

(54) COOLER APPARATUS AND CONTROL METHOD THEREFOR

(71) Applicants: Kentaro Mushiga, Toyota (JP); Osamu Shintani, Toyota (JP); Takuya Ikoma, Miyoshi (JP); Hideyuki Handa, Okazaki (JP)

(72) Inventors: Kentaro Mushiga, Toyota (JP); Osamu Shintani, Toyota (JP); Takuya Ikoma, Miyoshi (JP); Hideyuki Handa, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 131 days.

(21) Appl. No.: 14/397,885

(22) PCT Filed: Nov. 15, 2013

(86) PCT No.: PCT/IB2013/002790

§ 371 (c)(1),
(2) Date: Oct. 30, 2014

(87) PCT Pub. No.: WO2014/080278

PCT Pub. Date: May 30, 2014

(65) Prior Publication Data

US 2015/0247443 A1 Sep. 3, 2015

(30) Foreign Application Priority Data

Nov. 20, 2012 (JP) ..... 2012-254416

(51) Int. Cl.
*F01P 11/14* (2006.01)
*F01P 11/02* (2006.01)
(Continued)

(52) U.S. Cl.
CPC ..... *F01P 11/14* (2013.01); *F01P 5/12* (2013.01); *F01P 7/14* (2013.01); *F01P 11/02* (2013.01);
(Continued)

(58) Field of Classification Search
CPC ..... F01P 11/14; F01P 5/12; F01P 7/14; F01P 11/02; F01P 11/16; F01P 11/18; F01P 11/0204
See application file for complete search history.

(56) References Cited

U.S. PATENT DOCUMENTS 5,477,816 A 12/1995 Ranzinger et al.
5,572,958 A 11/1996 Mader et al.
(Continued)

FOREIGN PATENT DOCUMENTS

DE 958 887 C 2/1957
DE 103 18 355 A1 12/2004
(Continued)

*Primary Examiner* — Jacob Amick
(74) *Attorney, Agent, or Firm* — Oliff PLC

(57) ABSTRACT

A cooler apparatus includes: a coolant passageway; a water pump that circulates coolant in the coolant passageway; a thermostat that includes a heater that heats a temperature sensitive portion; and a controller. The controller is configured to drive the water pump and cause electric current to flow through the heater at a first energization amount when an operation in which the coolant is injected into the coolant passageway is started. The controller is also configured to stop electric current to flow through the heater if the water pump races when the electric current flows through the heater at the first energization amount.

8 Claims, 5 Drawing Sheets

(51) Int. Cl.

| | |
|---|---|
| ***F01P 11/18*** | (2006.01) |
| ***F01P 7/14*** | (2006.01) |
| *F01P 7/16* | (2006.01) |
| *F01P 5/12* | (2006.01) |

(52) U.S. Cl.
CPC ..... *F01P 11/0204* (2013.01); *F01P 11/18* (2013.01); *F01P 7/16* (2013.01); *F01P 2005/125* (2013.01); *F01P 2070/04* (2013.01)

(56) References Cited

U.S. PATENT DOCUMENTS

| | | | | |
|---|---|---|---|---|
| 6,662,761 | B1 | 12/2003 | Melchior | |
| 2009/0126656 | A1* | 5/2009 | Mounetou | F01P 7/167 123/41.1 |
| 2010/0071637 | A1* | 3/2010 | Shintani | F01P 11/028 123/41.02 |

FOREIGN PATENT DOCUMENTS

| | | | |
|---|---|---|---|
| DE | 10 2010 024 766 | A1 | 12/2011 |
| EP | 0 644 320 | A1 | 3/1995 |
| EP | 0 688 942 | A1 | 12/1995 |
| JP | A-2008-180160 | | 8/2008 |
| JP | A-2009-185744 | | 8/2009 |
| WO | 01/12964 | A1 | 2/2001 |

* cited by examiner

COOLER APPARATUS AND CONTROL METHOD THEREFOR

BACKGROUND OF THE INVENTION

1. Field of the Invention

The invention relates to a cooler apparatus and a control method for the cooler apparatus.

2. Description of Related Art

There have been known cooler apparatuses equipped with a coolant passageway, and a water pump and a thermostat that are provided on the coolant passageway (see, e.g., Japanese Patent Application Publication No. 2009-185744 (JP 2009-185744 A)). This thermostat has a heater that heats a temperature sensitive portion, and is capable of forcing its valve to open, irrespective of the temperature of the coolant.

A cooler apparatus of Japanese Patent Application Publication No. 2009-185744 (JP 2009-185744 A) is constructed so that when a coolant injection start signal is input, electric current is caused to flow through the heater of the thermostat so that the thermostat is forced to open its valve so as to drain air from the coolant passageway.

However, as for the related-art cooler apparatus disclosed in Japanese Patent Application Publication No. 2009-185744 (JP 2009-185744 A), there is possibility that if a worker's operation of injecting coolant is interrupted, energization of the heater may be continued with the thermostat not supplied with coolant. In such a case, it is conceivable that the thermostat will be excessively heated and therefore the thermostat will fail.

SUMMARY OF THE INVENTION

The invention provides a cooler apparatus that restrains a thermostat from failing, and a control method for the cooler apparatus.

A cooler apparatus in a first aspect of the invention includes: a coolant passageway; a water pump that circulates coolant in the coolant passageway; a thermostat that includes a heater that heats a temperature sensitive portion; and a controller configured to drive the water pump and cause electric current to flow through the heater at a first energization amount when an operation in which the coolant is injected into the coolant passageway is started, the controller being configured to stop the electric current to flow through the heater if the water pump races when the electric current flows through the heater at the first energization amount.

Due to the foregoing aspect, in the case where the operation in which the coolant is injected into the coolant passage by a worker is interrupted and therefore the thermostat is not supplied with the coolant, electric current is stopped from flowing through the heater, so that excessive heating of the thermostat can be restrained. Therefore, the thermostat can be restrained from failing.

In the foregoing aspect, the controller may output a warning indicating that the coolant in the coolant passageway is insufficient in amount, if the water pump races when the electric current flows through the heater at the first energization amount.

Due to the foregoing construction, insufficiency of the coolant in amount can be notified to workers.

In the foregoing aspect, the controller may cause the electric current to flow through the heater at a second energization amount that is greater than the first energization amount, if the water pump is not racing when electric current flows through the heater at the first energization amount.

Due to the foregoing construction, air can be drained from the coolant passageway if a worker's operation of injecting the coolant into the coolant passageway is appropriately performed.

According to the cooler apparatus in the aspect of the invention, the thermostat can be restrained from failing. In the foregoing aspect, the controller may be configured to stop the electric current to flow through the heater in a case that the water pump races after elapse of a predetermined time from a time when electric current starts to flow through the heater at the first energization amount. In the forgoing aspect, the cooler apparatus may further include a radiator provided on the coolant passageway, and may be constructed so that the predetermined time is a time that is required in order for the coolant passageway to be filled with the coolant when the coolant is injected into the passageway via a filling port of the radiator while water pump is being driven. In the foregoing aspect, the cooler apparatus may further include a maintenance-purpose tool configured to input a signal to the controller, the signal indicating that the operation in which the coolant is injected into the coolant passageway has started, and may be constructed so that when the signal is input to the controller from the maintenance-purpose tool, the controller determines that the operation in which the coolant is injected into the coolant passageway has started. In the foregoing aspect, the cooler apparatus may further include a sensor configured to detect rotation speed of the water pump, and may be constructed so that the controller determines that the water pump is racing, if the rotation speed detected by the sensor is higher than a target rotation speed of the water pump.

Furthermore, a second aspect of the invention is a control method for a cooler apparatus that includes a coolant passageway, a water pump configured to circulate coolant in the coolant passageway, and a thermostat having a heater that heats a temperature sensitive portion. The control method includes: driving the water pump and causing electric current to flow through the heater at a first energization amount when an operation in which the coolant is injected into the coolant passageway is started; and stopping the electric current to flow through the heater if the water pump races when the electric current flows through the heater at the first energization amount.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of the invention will be described hereinafter with reference to the drawings.

Firstly, with reference to FIGS. 1 and 2, a construction of a cooler apparatus 100 according to an embodiment of the invention will be described.

Figure 1:
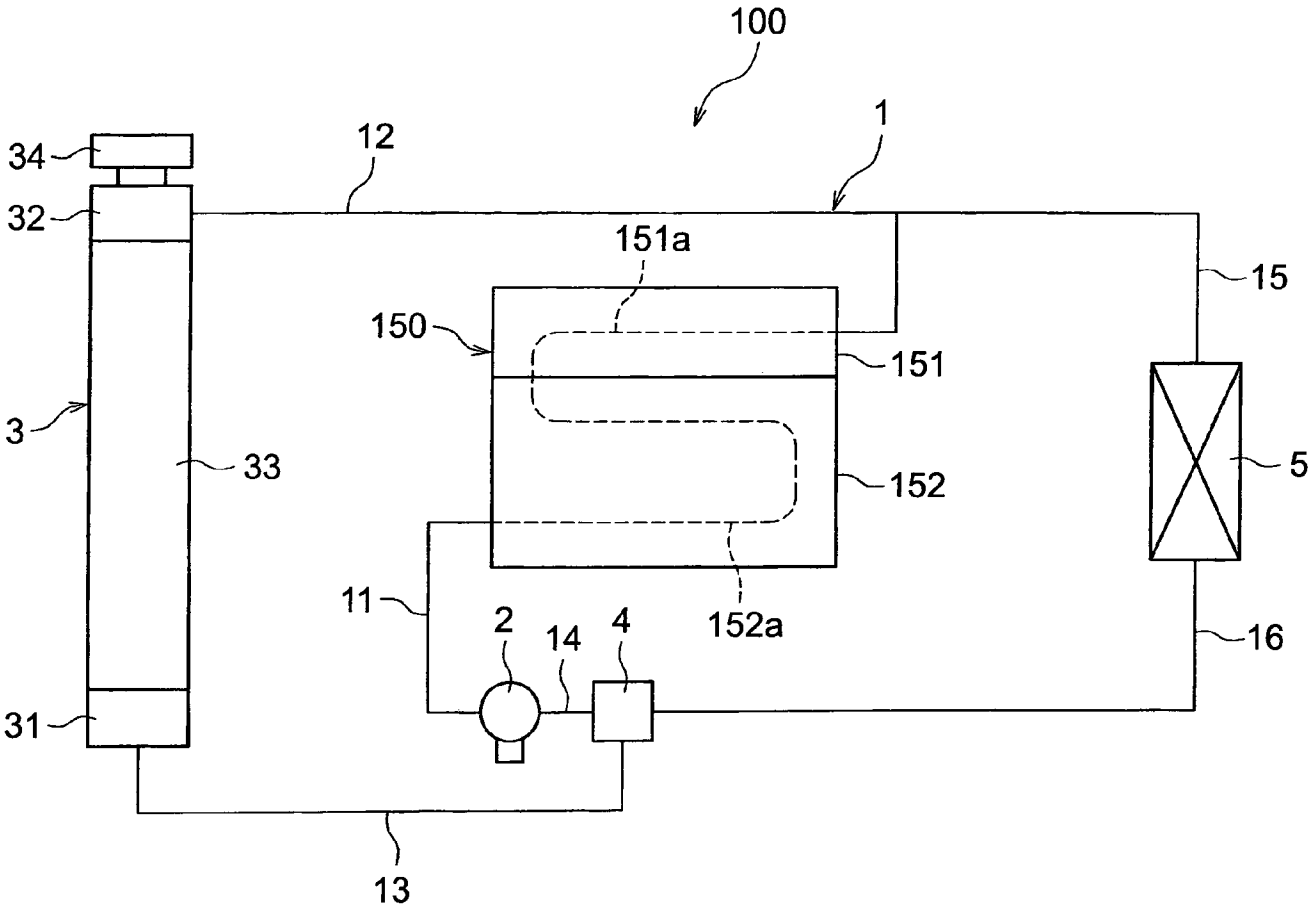
FIG. 1 is a circuit diagram showing a cooler apparatus according to an embodiment of the invention.

As shown in FIG. 1, the cooler apparatus 100 includes a coolant passageway 1, an electric water pump 2 that circulates coolant in the coolant passageway 1, a radiator 3 that cools the coolant that circulates in the coolant passageway 1, and a thermostat 4 and a heater core 5 that are disposed on a path of the coolant passageway 1. This cooler apparatus 100 is constructed so as to cool an engine (internal combustion engine) 150 by the coolant that circulates in the coolant passageway 1.

The engine 150 is a gasoline engine or a diesel engine mounted in a vehicle. The engine 150 includes a cylinder head 151 and a cylinder block 152. Within the cylinder head 151 there is formed a head-side water jacket (intra-head coolant passageway) 151*a* for cooling the cylinder head 151. Within the block 152 there is formed a block-side water jacket (intra-block coolant passageway) 152*a* for cooling the cylinder block 152. Incidentally, in the engine 150 according to the embodiment, the head-side water jacket 151*a* and the block-side water jacket 152*a* communicate with each other.

The coolant passageway 1 includes a passageway 11 that connects the electric water pump 2 and the engine 150, a passageway 12 that connects the engine 150 and the radiator 3, a passageway 13 that connects the radiator 3 and the thermostat 4, and a passageway 14 that connects the thermostat 4 and the electric water pump 2. The coolant passageway 1 further includes a passageway 15 that connects the engine 150 and the heater core 5, and a passageway 16 that connects the heater core 5 and the thermostat 4.

Concretely, the passageway 11 connects a discharge port of the electric water pump 2 and an inlet opening of the engine 150 (the block-side water jacket 152*a*). The passageway 12 connects an outlet opening of the engine 150 (the head-side water jacket 151*a*) and an upper tank 32 of the radiator 3. The passageway 13 connects a lower tank 31 of the radiator 3 and one of two inlet openings of the thermostat 4. The passageway 14 connects an outlet opening of the thermostat 4 and a suction port of the electric water pump 2. The passageway 15 connects the outlet opening of the engine 150 (the head-side water jacket 151*a*) and an inlet opening of the heater core 5. The passageway 16 connects an outlet opening of the heater core 5 and the other one of the two inlet openings of the thermostat 4.

The electric water pump 2 has a function of producing streams for circulating the coolant. The electric water pump 2 has an electric motor (not shown) that is driven by electric power from a battery (not shown). By controlling the rotation speed of the electric motor, the discharge flow rate (ejection pressure) can be variably set. Incidentally, the electric water pump 2 is controlled by an ECU 6 (see FIG. 2) so that the discharge flow rate is controlled according to the state of operation of the engine 150 and the like.

The radiator 3 is, for example, of a down-flow type, and includes the lower tank 31, the upper tank 32, and a radiator core 33 disposed between the lower tank 31 and the upper tank 32. The radiator 3 is constructed so as to release heat from the coolant to the outside through heat exchange between the coolant and the outside air when the coolant recovered in the upper tank 32 flows down toward the lower tank through an interior of the radiator core 33.

Furthermore, a radiator cap 34 is detachably attached to the upper tank 32 of the radiator 3. The radiator cap 34 has a function of keeping the internal pressure of the coolant passageway 1 at or above the atmospheric pressure and thus heightening the boiling point of the coolant so that the efficiency of heat exchange in the radiator core 33 is increased. Incidentally, the radiator cap 34 is removed from the upper tank 32 when the coolant is injected into the coolant passageway 1 (when the coolant is replaced). On this occasion, a filling port (not shown) of the radiator 3 is made open, so that the coolant passageway 1 communicates with the atmosphere.

The thermostat 4 is a valve device that is actuated by, for example, expansion and contraction of a thermo wax (a temperature sensitive portion). This thermostat 4 has a heater 41 (see FIG. 2) that is embedded within the thermo wax. The temperature of the wax can be controlled by the heat produced by energization of the heater 41. That is, as for the thermostat 4, the valve opening temperature (the valve of the coolant at which the thermostat 4 opens) can be controlled by controlling the current that is passed through the heater 41. Incidentally, the current passed through the heater 41 is controlled by the ECU 6.

The thermostat 4 is constructed so that when the temperature of the coolant is low, the valve is closed to shut off the passageway between the lower tank 31 of the radiator 3 and the electric water pump 2. Furthermore, the thermostat 4 is constructed so that when the coolant temperature is high, the valve is opened to provide communication between the lower tank 31 of the radiator 3 and the electric water pump 2.

The heater core 5 is provided for the purpose of heating a cabin of the vehicle by utilizing heat of the coolant, and is disposed so as to face a blower duct of an air-conditioner. That is, when the cabin is heated (when the heater is on), air-conditioned wind flowing in the blower duct passes by the heater core 5, and is thereby turned into warm wind before it is supplied into the cabin. On other occasions (e.g., at the time of cooling the cabin) (i.e., when the heater is off), the air-conditioned wind bypasses the heater core 5.

Figure 2:
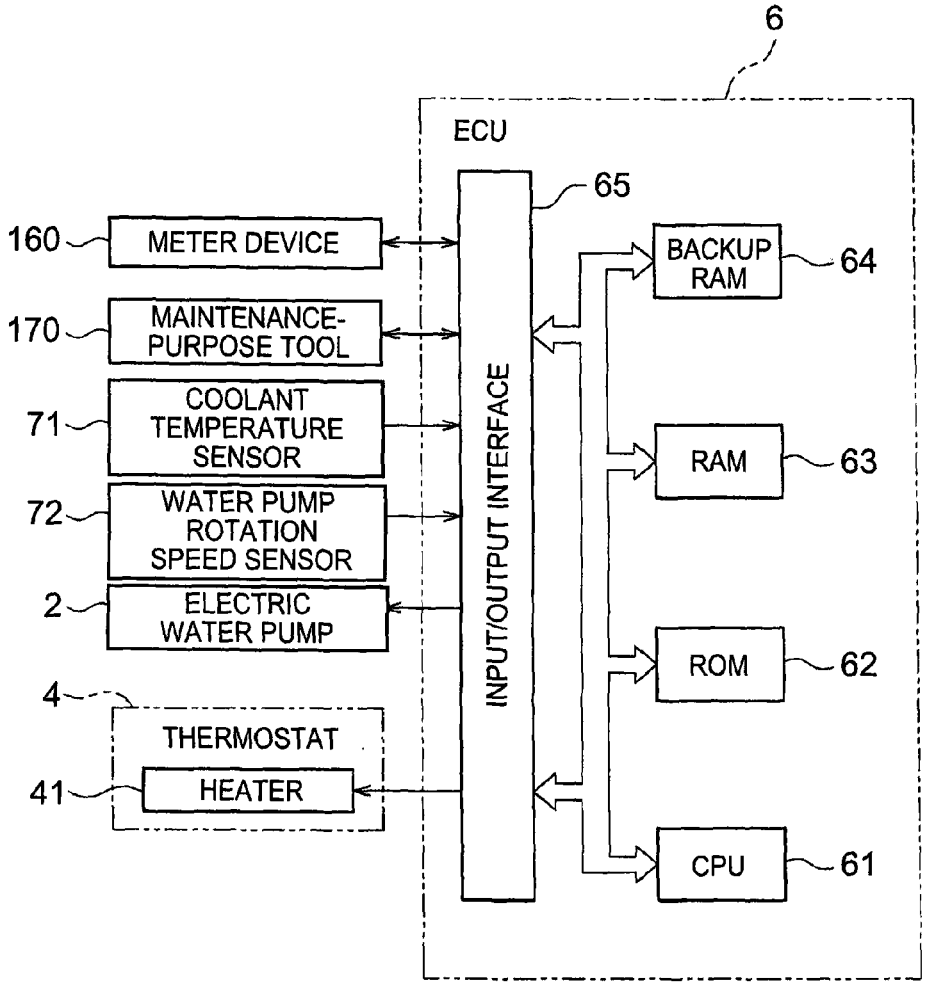
FIG. 2 is a block diagram showing an electrical construction of the cooler apparatus shown in FIG. 1.

Furthermore, the cooler apparatus 100 includes the ECU 6 that controls the cooler apparatus 100, as shown in FIG. 2. This ECU 6 includes a CPU 61, a ROM 62, a RAM 63, a backup RAM 64, and an input/output interface 65.

The CPU 61 has a function of executing computation processes on the basis of various control programs and maps that are stored in the ROM 62. The ROM 62 stores various control programs, maps that are referred to at the time of execution of the control programs, etc. The RAM 63 is a memory for temporarily storing results of computation performed by the CPU 61, detection results provided by various sensors, etc. The backup RAM 64 is a non-volatile memory for storing data or the like that need to be stored when the engine 150 is stopped.

The input/output interface 65 is connected to a water temperature sensor 71 that detects the temperature of the coolant, a water pump rotation speed sensor 72 that detects the rotation speed of the electric water pump 2, etc. Detection results provided by the various sensors are input to the input/output interface 65. The water temperature sensor 71 is disposed near the outlet opening of the engine 150 (the head-side water jacket 151*a*). The water pump rotation speed sensor 72 is disposed near a rotating shaft of the electric water pump 2.

Furthermore, the heater 41 of the thermostat 4, the electric water pump 2, etc. are also connected to the input/output interface 65. The ECU 6 is constructed so as to control the valve opening temperature of the thermostat 4 by controlling the energization amount (duty ratio) of the heater 41. Furthermore, the ECU 6 is constructed so as to, control the electric water pump 2 according to the state of operation of the engine 150, and the like.

Still further, a meter device 160 that displays various kinds of information is connected to the input/output interface 65. Furthermore, a maintenance-purpose tool 170 for reading out information regarding failures of the vehicle, etc., is detachably connected to the input/output interface 65. The maintenance-purpose tool 170 is constructed so as to output to the ECU 6 a signal indicating that an operation in which the coolant is injected into the coolant passageway 1 has started.

It is recommended that the coolant in the coolant passageway be periodically replaced. After replacement of the coolant in the coolant passageway 1, it is necessary to drain air from the coolant passageway 1. Therefore, after an action of circulating the coolant in the coolant passageway 1 at an ordinary time is described, an action performed at the time of the operation in which the coolant is injected into the coolant passageway 1 will be described in detail. Incidentally, the discharging of the coolant from the coolant passageway 1 is carried out by a worker removing a drain bolt (not shown) provided on a lower portion of the radiator and also removing the radiator cap 34. At this time, a drain bolt (not shown) provided on the cylinder block 152 of the engine 150 may also be removed. Furthermore, injection of the coolant into the coolant passageway 1 is carried out via the filling port that is opened by removing the radiator cap 34.

Coolant Circulating Action

Next, with reference to FIGS. 3 and 4, a coolant circulating action in the cooler apparatus 100 according to an embodiment of the invention will be described.

Figure 3:
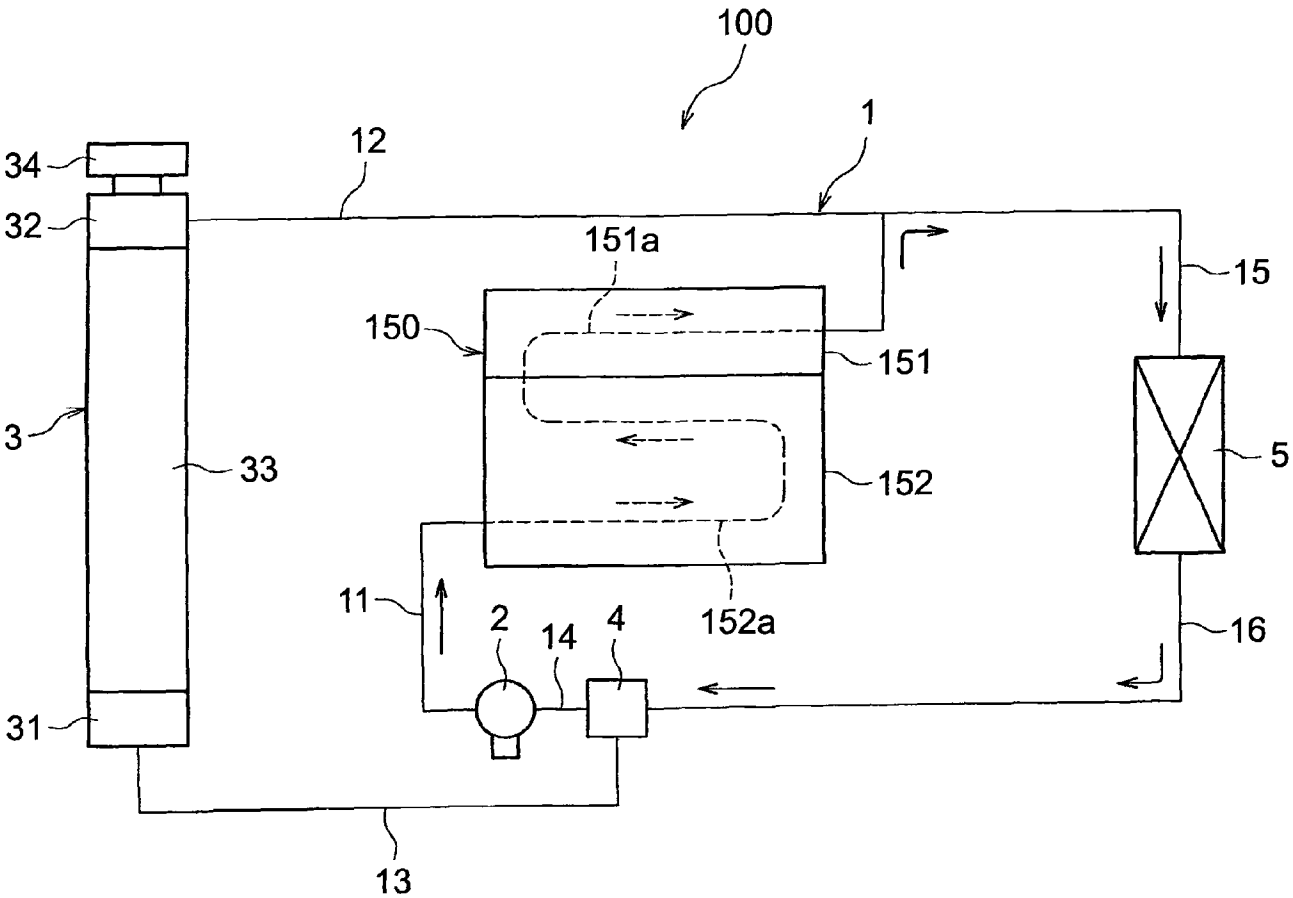
FIG. 3 is a diagram for describing a coolant circulating action performed during a cold state by a cooler apparatus according to an embodiment of the invention.

[ACTION DURING COLD STATE (DURING WARM-UP)] Firstly, immediately after the engine 150 is started, the temperature of the coolant is low, so that the thermostat 4 is in the closed valve state, as shown in FIG. 3.

Then, as the electric water pump 2 is driven, the coolant is caused to flow through the electric water pump 2, the passageway 11, the block-side water jacket 152*a*, the head-side water jacket 151*a*, the passageway 15, the heater core 5, the passageway 16, the thermostat 4, the passageway 14 and the electric water pump 2 in this order.

Therefore, since the circulating coolant bypasses the radiator 3, the coolant is not cooled by the radiator 3, so that the warm-up of the engine 150 is completed accordingly earlier.

Figure 4:
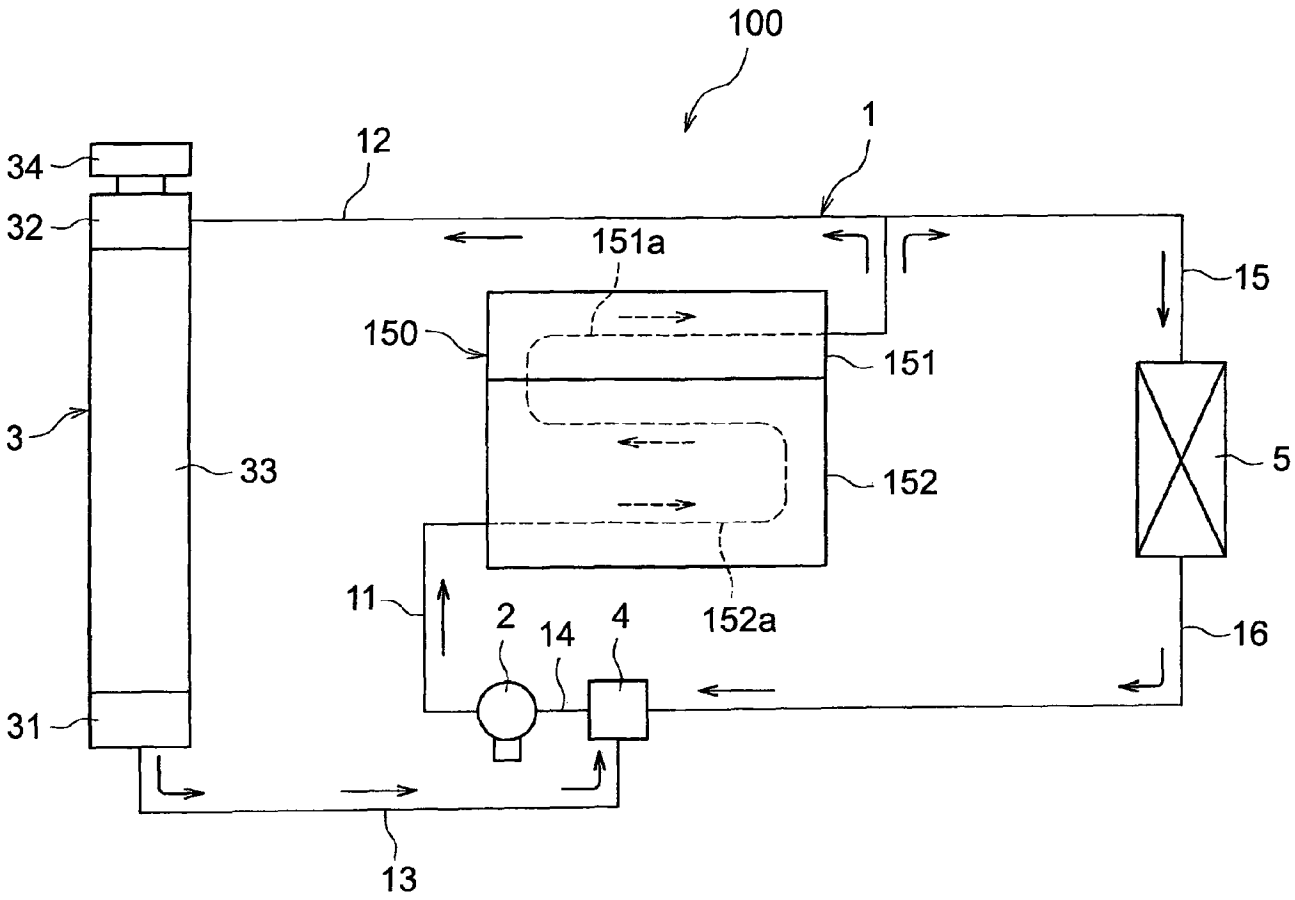
FIG. 4 is a diagram for describing a coolant circulating action performed during a completely warmed-up state by a cooler apparatus according to an embodiment of the invention.

[ACTION DURING COMPLETELY WARMED-UP STATE (AFTER WARM-UP IS COMPLETED)] Then, as the temperature of the coolant increases, the thermostat 4 opens its valve as shown in FIG. 4.

Since the electric water pump 2 is driven, the coolant is caused flow through the electric water pump 2, the passageway 11, the block-side water jacket 152*a*, the head-side water jacket 151*a*, the passageway 12, the radiator 3, the passageway 13, the thermostat 4, the passageway 14 and the electric water pump 2 in this order, in addition to the aforementioned path. That is, the coolant having flown out of the head-side water jacket 151*a* branches toward the radiator 3, and the coolant having passed through the radiator 3 merges, at the thermostat 4, with the coolant from the heater core 5.

Therefore, part of the coolant flows through the radiator 3, so that heat of the coolant is released to the external air.

Action Performed at the Time of Operation of Injecting Coolant

Next, the action performed at the time of the operation of injecting the coolant in the cooler apparatus 100*b* will be described with reference to FIG. 5. Incidentally, the steps described below are executed by the ECU 6 (see FIG. 2).

Figure 5:
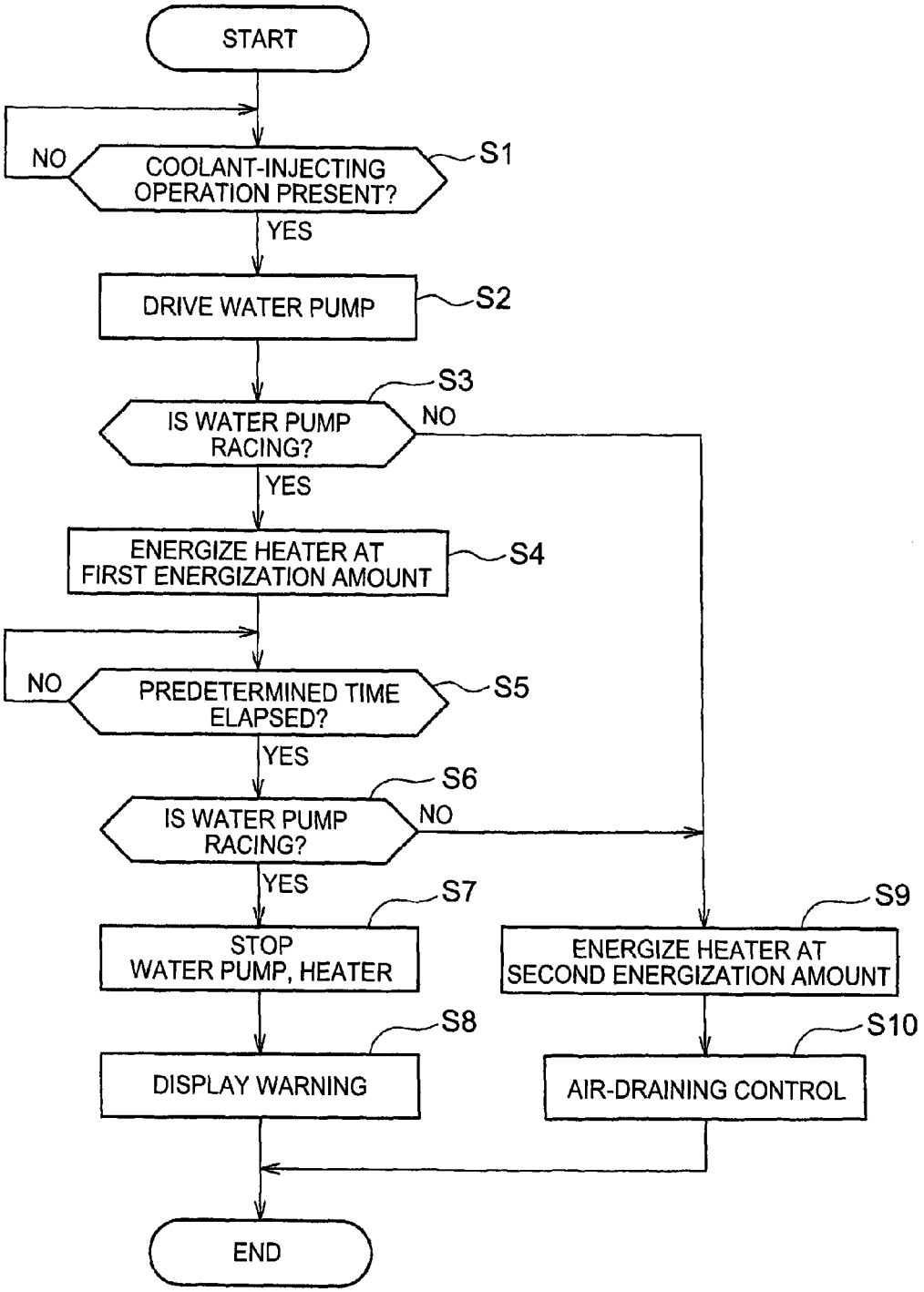
FIG. 5 is a flowchart for describing an action performed by a cooler apparatus according to an embodiment of the invention at the time of an operation of injecting coolant.

Firstly, in step S1 in FIG. 5, it is determined whether the operation in which the coolant is injected into the coolant passageway 1 (see FIG. 1) has started. Incidentally, whether the operation in which the coolant is injected into the coolant passageway 1 has started is determined on the basis of, for example, a signal input from the maintenance-purpose tool 170 (see FIG. 2). Concretely, if a signal indicating that the operation in which the coolant is injected has started is input from the maintenance-purpose tool 170, it is determined that the operation in which the coolant is injected into the coolant passageway 1 has started. Then, if it is determined that the operation in which the coolant is injected has started, the process proceeds to step S2. On the other hand, if it is determined that the operation in which the coolant is injected has not started, step S1 is repeated.

Next, in step S2, the electric water pump 2 (see FIG. 2) is driven. Incidentally, the driving of the electric water pump 2 is performed, irrespective of the state of operation of the engine 150.

Then, in step S3, it is determined whether the electric water pump 2 is racing. Incidentally, in this determination, it is determined that the electric water pump 2 is racing, for example, in the case where an actual rotation speed of the electric water pump 2 detected by the water pump rotation speed sensor 72 (see FIG. 2) is higher than a target rotation speed of the electric water pump 2 output from the ECU 6. Then, if it is determined that the electric water pump 2 is racing, it is considered that the coolant present in the coolant passageway 1 is insufficient in amount. Then, the process proceeds to step S4. On the other hand, if it is determined that the electric water pump 2 is not racing, it is considered that the coolant passageway 1 is filled with the coolant, and then the process proceeds to step S9.

Next, in step S4, the heater 41 (see FIG. 2) of the thermostat 4 is energized at a first energization amount. Due to this, the thermostat 4 is forced to open, irrespective of the temperature of the coolant and the like. Incidentally, at this time, the thermostat 4 is opened to a first degree of opening. Furthermore, the first energization amount is a pre-set value that is smaller than a second energization amount mentioned below, and the first degree of opening is such a degree of opening that, for example, in the case where the coolant is being injected into the radiator 3, the injected coolant can be supplied to the electric water pump 2.

Next, in step S5, it is determined whether a predetermined time has elapsed. Incidentally, the predetermined time is a pre-set time, for example, a time that is required in order to fill the coolant passageway 1 with the coolant in the case where the coolant is injected via the filling port of the radiator 3 while the electric water pump 2 is being driven. Then, if it is determined that the predetermined time has not elapsed, step 5 is repeated. That is, the ECU 6 waits until the predetermined time elapses. Then, when it is determined that the predetermined time has elapsed, the process proceeds to step S6.

Next, in step S6, it is determined whether the electric water pump 2 is racing. This determination is performed in the same manner as in step S3. Then, if it is determined that the electric water pump 2 is racing, it is considered that the coolant present in the coolant passageway 1 is insufficient in amount. Then, the process proceeds to step S7. On the other hand, if it is determined that the electric water pump 2 is not racing, it is considered that the coolant passageway 1 is filled with the coolant, and the process proceeds to step S9.

Next, in step S7, the energization of the heater 41 of the thermostat 4 is stopped, and the driving of the electric water pump 2 is stopped. Then, in step S8, the meter device 160

(see FIG. 2) is caused to display a warning indicating that the coolant in the coolant passageway 1 is insufficient in amount. After that, the action performed at the time of the operation in which the coolant is injected is ended.

Firstly, if the electric water pump 2 is not racing (No in step S3 or NO in step S6), the heater 41 of the thermostat 4 is energized at a second energization amount in step S9. Therefore, the thermostat 4 is forced to open its valve, irrespective of the temperature of the coolant and the like. Incidentally, at this time, the thermostat 4 is opened to a second degree of opening. The second energization amount is a pre-set value that is greater than the first energization amount, and the second degree of opening is a degree of opening at which the thermostat 4 is completely open (fully open).

Then, in step S10, a control of draining air from the coolant passageway 1 during a state in which the thermostat 4 is open at the second degree of opening is executed. Incidentally, this air-draining control is performed by, for example, increasing or decreasing the discharge flow rate of the electric water pump 2. Concretely, the air-draining control is performed as follows. That is, air residing at locations where flow is relatively easy is caused to flow by driving the electric water pump 2 at a first discharge flow rate, and then air residing at locations where flow is less easy is caused to flow by driving the electric water pump 2 at a second discharge flow rate that is greater than the first discharge flow rate. After that, the action performed at the time of the operation in which the coolant is injected is ended.

Effects

In this embodiment, the heater 41 is energized at the first energization amount and, if the electric water pump 2 is racing after the predetermined time has elapsed, the energization of the heater 41 is stopped. Therefore, in the case where the coolant is not being supplied to the thermostat 4 due to interruption of the worker's operation of injecting the coolant, the energization of the heater 41 is stopped, so that excessive heating of the thermostat 4 can be restrained. Therefore, the thermostat 4 can be restrained from failing.

Furthermore, in the embodiment, if the heater 41 is energized at the first energization amount and then the electric water pump 2 is racing after the predetermined time elapses, the warning indicating that the coolant in the coolant passageway 1 is insufficient in amount is displayed on the meter device 160, so that the insufficiency of the coolant in amount in the coolant passageway can be notified to a worker.

Furthermore, in the embodiment, if the heater 41 is energized at the first energization amount and then the electric water pump 2 is not racing after the predetermined time elapses, the control of draining air from the coolant passageway 1 by energizing the heater 41 at the second energization amount is performed. Therefore, in the case where the operation in which the coolant is injected by the worker is appropriately performed, air in the coolant passageway 1 can be drained.

Furthermore, in the embodiment, before the heater 41 is energized at the first energization amount, it is determined whether the electric water pump 2 is racing. If the electric water pump 2 is not racing, the control of draining air by energizing the heater 41 at the second energization amount. Therefore, in the case where the coolant passageway 1 is filled with the coolant, the control of draining air can be carried out early.

Other Embodiments

The embodiments disclosed herein are illustrative in all respects, and do not serve as a basis for limitative interpretation. Therefore, the technical scope of the invention is not to be interpreted only by the forgoing embodiments, but is defined on the basis of what is described in the claims for patent. Furthermore, the technical scope of the invention includes all modifications and alterations within the meaning and scope equivalent to the claims.

For example, in the foregoing embodiment, the cooler apparatus 100 equipped with the heater core 5 is shown. However, the invention is not limited to this construction. The invention may also be applied to cooler apparatuses equipped with other heat exchangers, such as EGR coolers and the like.

Furthermore, in the embodiment, the cooler apparatus 100 is provided with only one thermostat 4. However, this is not restrictive. The cooler apparatus may also be provided with a plurality of thermostats.

Furthermore, in the embodiment, before the heater 41 is energized at the first energization amount, it is determined whether the electric water pump 2 is racing. However, this is not restrictive. It is permissible not to determine whether the electric water pump is racing before the heater is energized at the first energization amount. That is, the process of step S3 shown in FIG. 5 may be omitted.

Furthermore, although in the embodiment, the first energization amount and the second energization amount are pre-set values, this is not restrictive. The first energization amount and the second energization amount may be changed according to the temperature of the coolant.

Furthermore, although in the embodiment, it is determined whether the coolant-injecting operation has been performed on the basis of the signal input from the maintenance-purpose tool 170, this is not restrictive. Whether the cooling-injecting operation has been performed may be determined on the basis of a signal input from an operating portion (not shown) of the vehicle.

Further, although in the embodiment, the meter device 160 is caused to display the warning indicating that the coolant in the coolant passageway 1 is insufficient in amount, this is not restrictive. The maintenance-purpose tool may be caused to display the warning indicating that the coolant in the coolant passageway is insufficient in amount.

The invention is applicable to a cooler apparatus for an engine and, more particularly, can be effectively used in a cooler apparatus that performs a control of draining air by forcing the thermostat to open its valve.

The invention claimed is:

1. A cooler apparatus comprising:

a coolant passageway;

a water pump configured to circulate coolant in the coolant passageway;

a thermostat including a heater that heats a temperature sensitive portion; and a controller configured to drive the water pump and cause electric current to flow through the heater at a first energization amount when an operation in which the coolant is injected into the coolant passageway is started, the controller being configured to stop the electric current to flow through the heater when the water pump races while the electric current flows through the heater at the first energization amount.

2. The cooler apparatus according to claim 1, wherein the controller outputs a warning indicating that the coolant in the coolant passageway is insufficient in amount, when the water pump races while the electric current flows through the heater at the first energization amount.

3. The cooler apparatus according to claim 1, wherein the controller causes the electric current to flow through the heater at a second energization amount that is greater than the first energization amount, when the water pump is not racing while the electric current flows through the heater at the first energization amount.

4. The cooler apparatus according to claim 1, wherein the controller stops the electric current to flow through the heater in a case that the water pump races after elapse of a predetermined time from a time when the electric current starts to flow through the heater at the first energization amount.

5. The cooler apparatus according to claim 1, further comprising:

a radiator provided on the coolant passageway, wherein a predetermined time is a time that is required in order for the coolant passageway to be filled with the coolant when the coolant is injected into the coolant passageway via a filling port of the radiator while water pump is being driven.

6. The cooler apparatus according to claim 1, further comprising:

a maintenance-purpose tool configured to input a signal to the controller, the signal indicating that the operation in which the coolant is injected into the coolant passageway has started, wherein when the signal is input to the controller from the maintenance-purpose tool, the controller determines that the operation in which the coolant is injected into the coolant passageway has started.

7. The cooler apparatus according to claim 1, further comprising:

a sensor configured to detect rotation speed of the water pump, wherein the controller determines that the water pump is racing, when the rotation speed detected by the sensor is higher than a target rotation speed of the water pump.

8. A control method for a cooler apparatus including a coolant passageway, a water pump configured to circulate coolant in the coolant passageway, and a thermostat having a heater that heats a temperature sensitive portion, the control method comprising:

driving the water pump and causing electric current to flow through the heater at a first energization amount when an operation in which the coolant is injected into the coolant passageway is started; and stopping the electric current to flow through the heater when the water pump races while the electric current flows through the heater at the first energization amount.

* * * * *